US008113782B2

(12) United States Patent
Horng et al.

(10) Patent No.: US 8,113,782 B2
(45) Date of Patent: Feb. 14, 2012

(54) IMPELLER STRUCTURE OF BLOWER

(75) Inventors: Alex Horng, Kaohsiung (TW); Chen-His Lee, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 993 days.

(21) Appl. No.: 12/078,077

(22) Filed: Mar. 27, 2008

(65) Prior Publication Data

US 2009/0208340 A1 Aug. 20, 2009

(30) Foreign Application Priority Data

Feb. 20, 2008 (TW) ..... 97105832 A

(51) Int. Cl.
*F01D 11/02* (2006.01)

(52) U.S. Cl. ..... 416/178; 416/187; 416/228; 416/235; 416/237

(58) Field of Classification Search ..... 416/182, 416/183, 184, 185, 186 R, 178, 187, 188, 416/223 B, 228, 235, 237, 238
See application file for complete search history.

(56) References Cited

U.S. PATENT DOCUMENTS 3,692,428 A * 9/1972 Bubb et al. ..... 416/187
5,988,979 A * 11/1999 Wang ..... 416/178
6,095,752 A * 8/2000 Gronier et al. ..... 416/186 R
6,537,030 B1 * 3/2003 Garrison ..... 416/185
6,893,218 B2 * 5/2005 Ito ..... 415/198.1
7,125,226 B2 * 10/2006 Horng et al. ..... 416/203
7,207,779 B2 * 4/2007 Horng et al. ..... 416/186 R
2005/0095132 A1 * 5/2005 Kao et al. ..... 416/186 R

* cited by examiner

*Primary Examiner* — Igor Kershteyn

(74) *Attorney, Agent, or Firm* — Alan Kamrath; Kamrath IP Lawfirm, PA

(57) ABSTRACT

An impeller structure includes a hub having a central spindle, and an impeller. The impeller has a top connection ring, a bottom connection ring, a pressure-retaining ring and a plurality of blades vertically arranged around the periphery of the hub. A top side outer edge of each blade is connected with a top connection ring, an bottom side of the inner side of the blade is connected with a bottom connection ring, the outer side is connected with the pressure-retaining ring, and a plurality of ribs extend outwards from the bottom edge of the periphery of the hub connecting with the bottom connection ring. A pressure relief hole is provided between the pressure-retaining ring and the bottom connection ring. When air passes through the pressure relief hole, a pressure effect is generated, increasing air pressure and volume of blower, alleviating turbulence. The pressure-retaining ring also reinforces the blade strength.

10 Claims, 8 Drawing Sheets

IMPELLER STRUCTURE OF BLOWER

FIELD OF THE INVENTION

The present invention relates to an impeller structure of blower, and more particularly to that having an additional pressure-retaining ring on the bottom side of the impeller to increase air pressure and air volume of the blower and alleviate the turbulence generated while the impeller is operating by the pressure relief hole between the pressure-retaining ring and the bottom connection ring.

BACKGROUND OF THE INVENTION

Please refer to FIG. 1 and FIG. 2, which a top view and a cross-sectional view showing a conventional blower impeller. The impeller includes a hub 40 and an impeller 41. The hub 40 has a spindle disposed centrally therein and is connected with the impeller 41 by several swirl-like ribs 42.

The impeller 41 contains several blades 411, a pressure-retaining ring 43 and a top connection ring 44, in which the outer edge on the top side of each blade 411 is connected with a top connection ring 44, and a pressure-retaining ring 43 is disposed on the bottom side of the blades 411 to fully cover the bottom portion of the blades, has a fixed thickness and is a disc-like part that can prevent air flow from being released from the bottom portion of the blades, so as to enhance the function of static pressure and reinforce the strength of the blades as well.

Please refer to FIG. 2, which is a cross-sectional view showing the operation when a conventional blower impeller is disposed in a housing. External air (as indicated by arrowhead) enters from a spatial range surrounded by the periphery of the hub 40 and the inner end portion of the blade to form an axial flow. When the impeller rotates, the axial flow entering from the spatial range surrounded by the periphery of the hub 40 and the inner end point of the blade into the impeller is converted into a radial flow due to a centrifugal force resulting from the spinning effect and is stirred up by the blades 411 to exhaust. An external air flow entering from a place right above the blade 411 forms an axial air flow directly flowing down to the pressure-retaining ring 43. The pressure-retaining ring 43 can block air to prevent air from being directly released from the bottom portion of the blades 411 and from lacking of air pressure due to the air pressure release. Therefore, the pressure-retaining ring 43 can increase air pressure and air volume while the impeller is driving.

Whereas, when passing through the blades 411, the radial flow formed by the centrifugal force will confront with the axial flow entering from the place right above the blade 411 so that collision of the air flows from two different flow directions will happen. Such collision leads to the occurrence of turbulence which results in the instability of air-flowing direction of the impeller.

In view of the foregoing concern, to overcome the aforementioned drawbacks, the present invention provides an impeller having a plurality of pressure relief holes capable of reducing the occurrence of turbulence and further providing the function of increasing air pressure and air volume.

SUMMARY OF THE INVENTION

A first aspect of the present invention provides a function that increases air pressure and air volume and alleviate turbulence occurrence while an impeller is operating by using a plurality of pressure relief holes formed on the a space among a pressure-retaining ring and a connection ring and a bottom surface of two adjacent blades.

A second aspect of the present invention provides an impeller structure of blower to increase blade strength by adding a pressure-retaining ring with a specific width to a bottom surface of blades.

Preferably, the impeller structure of blower mainly includes a hub and an impeller, in which the hub has a spindle disposed centrally, the impeller has a top connection ring, a bottom connection ring, a pressure-retaining ring and a plurality of blades. The blades are vertically arranged around a periphery of the hub, an outer edge on a top side of the blade is connected to a top connection ring, an inner side of a bottom edge of the blade is connected to a bottom connection ring and an outer side is connected with the pressure-retaining ring, at least a pressure relief hole is provided on the space between the pressure-retaining ring and the bottom connection ring to make the bottom surface of the blades not completely enclosed, and a plurality of swirl-like ribs extended outwards from a bottom edge of the periphery of the hub are connected with the bottom connection ring.

When the impeller is rotating, a current of air of the external environment enters through a range surrounded by the hub and a place of the blades in the vicinity of the spindle to form an axial flow that is converted to a radial flow due to rotation of the blades and is stirred up and exhausted by the blades; another external current of air being an axial flow and entering from a place above the blade flows down to the pressure-retaining ring on a bottom portion and is exhausted through the pressure relief hole; the air released downwards through the pressure relief hole generates a pressure against a bottom surface of the housing of the blower, thereby speeding up the rotation of the impeller to achieve the effect of increasing air pressure and air volume and reducing occurrence of turbulence; a pressure-retaining ring with a specific width is added to the bottom portion of the impeller to feature the effect of reinforcing the strength of the blades.

The aforementioned object of the present invention and characteristics of the structure and function thereof are depicted in accordance with the preferred embodiments in the attached figures.

DETAILED DESCRIPTION OF THE PREFERRED EMBODIMENT

To stand out and comprehend the aforementioned objective, features and advantages of the present invention more, preferred embodiments of the present invention are specifically presented as follows in conjunction with detailed illustrative description.

Figure 1:
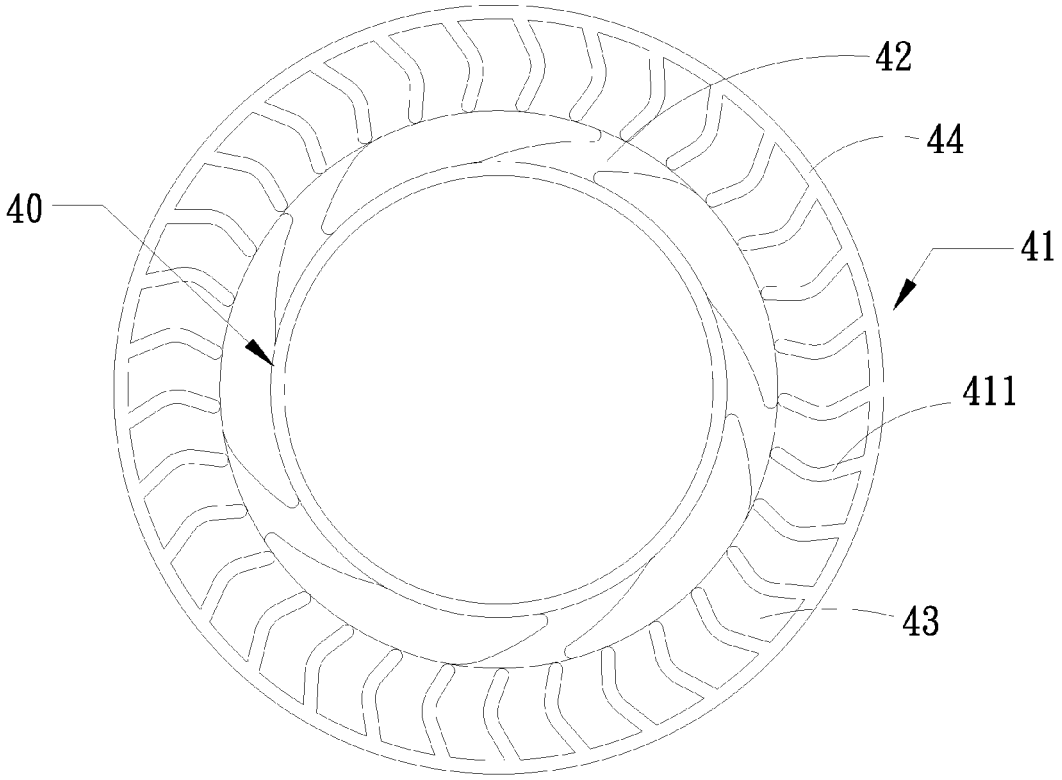
Figure 1 PRIOR ART
FIG. 1 is a top view showing an impeller structure of a conventional blower.
Figure 2:
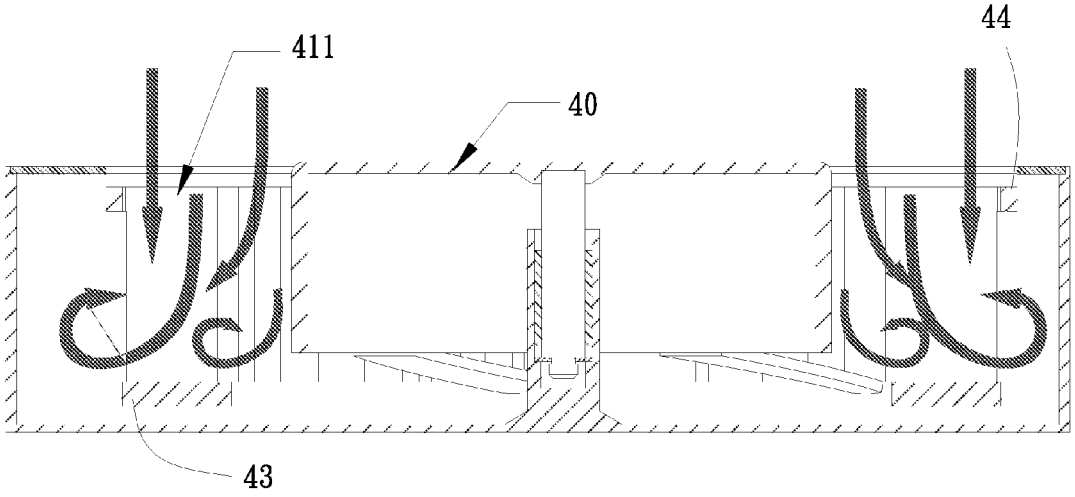
Figure 2 PRIOR ART
FIG. 2 is a cross-sectional view showing the operation of the impeller structure of the conventional blower assembled in a housing.
Figure 3:
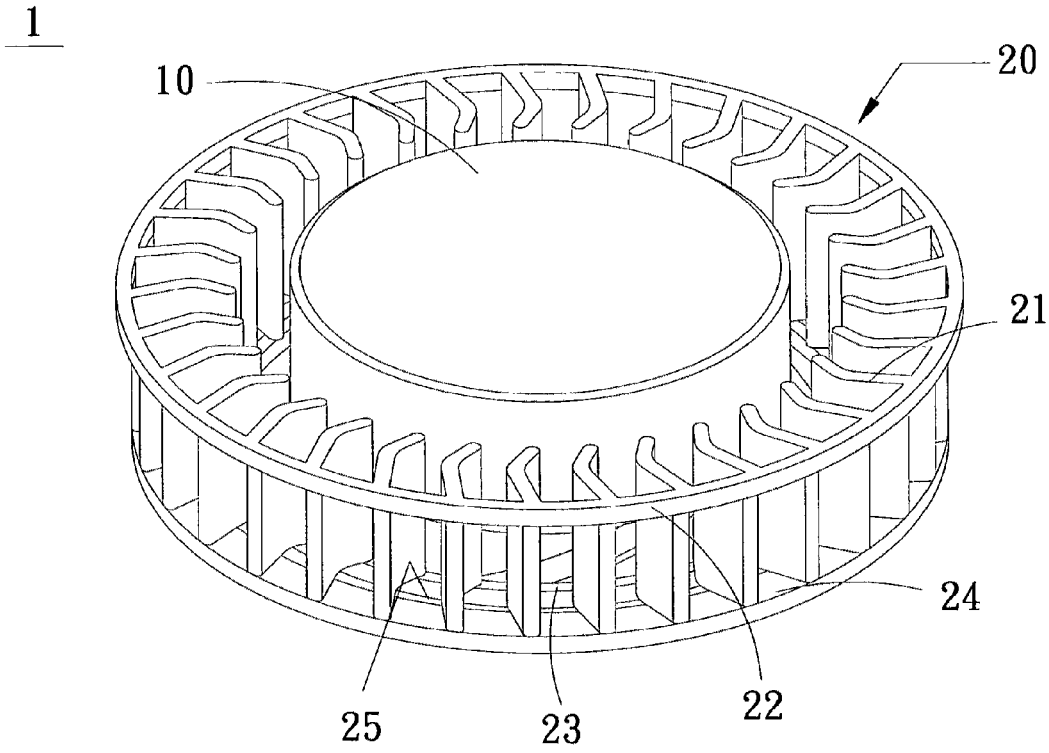
FIG. 3 is a three-dimensional view showing a preferred embodiment of the present invention.
Figure 4:
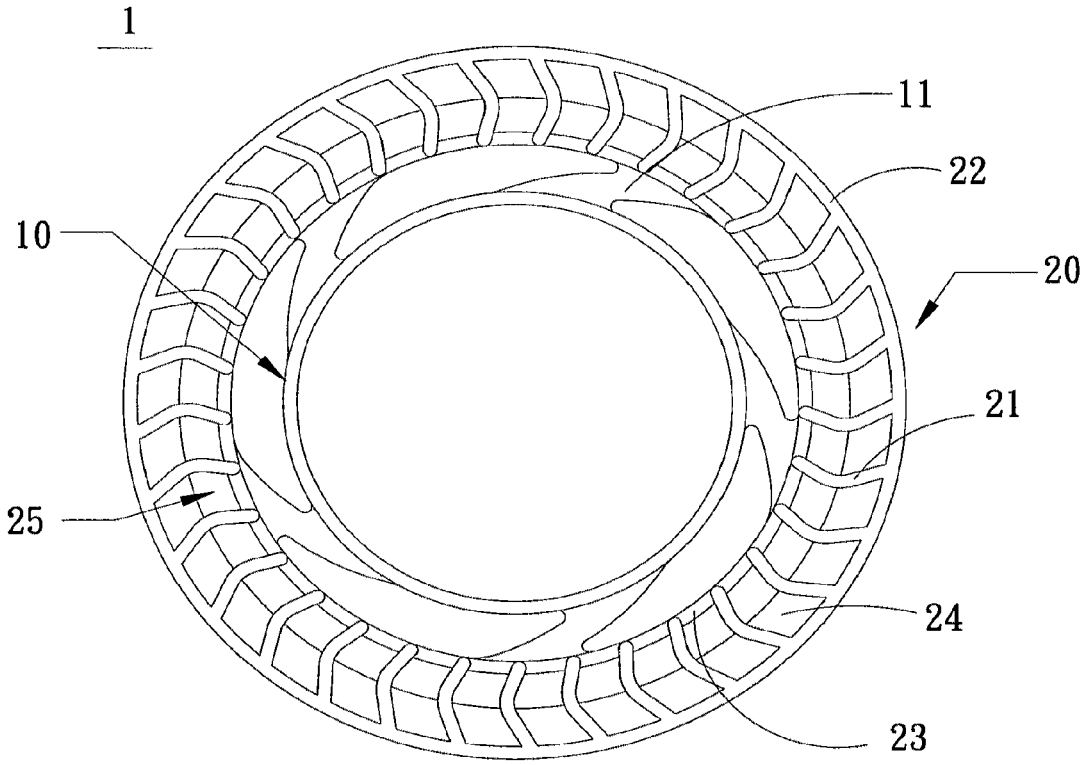
FIG. 4 is top view showing the preferred embodiment of the present invention.
Figure 5:
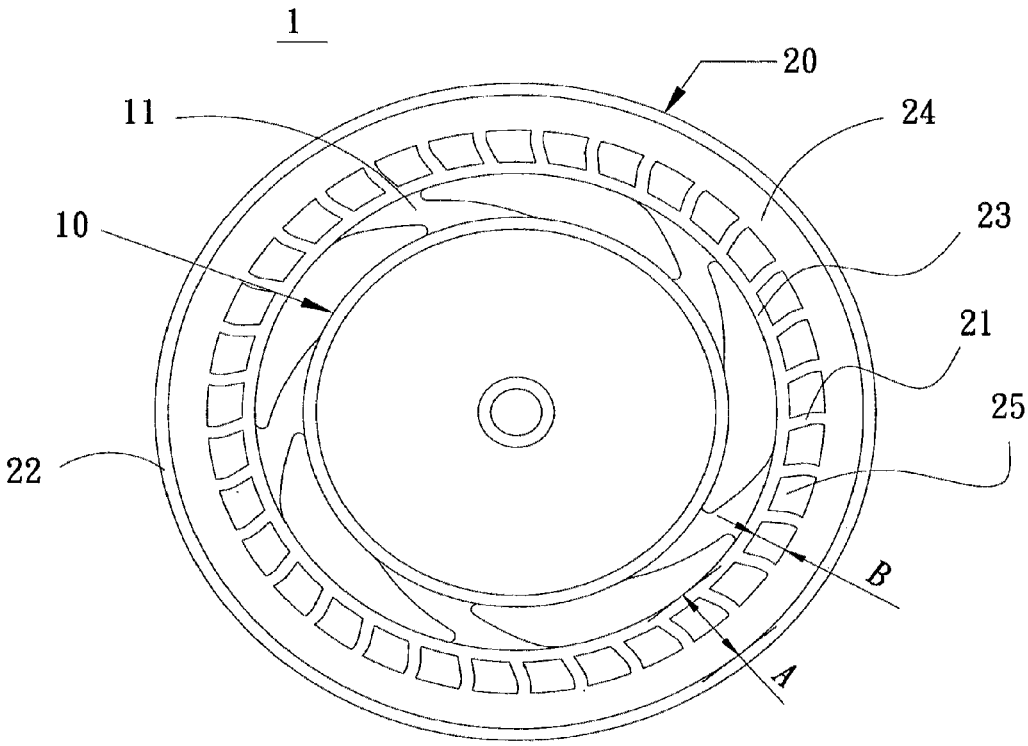
FIG. 5 is a bottom view showing the preferred embodiment of the present invention.

Please refer to FIG. 3, FIG. 4 and FIG. 5, which show the preferred embodiment of the impeller structure of blower in the present invention. The impeller structure 1 is integrally formed and mainly includes a hub and an impeller.

The hub 10 has a spindle disposed centrally therein; the impeller 20 contains a top connection ring 22, a bottom connection ring 23, a pressure-retaining ring 24 and a plurality of blades 21, in which the blades 21 are vertically arranged around the periphery of the hub 10, and an outmost edge of a top side of each blade 21 is connected with a top connection ring and an inner edge of a bottom side of each blade 21 is connected with a bottom connection ring 23 whose outer end is connected with a pressure-retaining ring 24 formed by extending an outer bottom edge of each blade 21 a radial width; a plurality of swirl-like ribs 11 are extended outwards from the outer periphery of the hub 10 and connected with the bottom connection ring 23.

Please refer to FIG. 4 and FIG. 5, which are the top views of the preferred embodiment of the present invention. The width of the pressure-retaining ring 24 is greater than that of the top connection ring 22 or the bottom connection ring 23, and at least a pressure relief hole 25 is located between the pressure-retaining ring 24 and the bottom connection ring so that the bottom portion of the impeller 20 is not fully enclosed. The pressure relief hole 25 is constituted by a space (B) formed among the bottom surface between two adjacent blades 21, the pressure-retaining ring 24 and the bottom connection ring 23. The space (B) is the width of the pressure-retaining hole 25, which is the distance from the inner diameter of the pressure-retaining ring 24 to the outer diameter of the bottom connection ring 23.

The space (A) indicated in FIG. 5 is the radial distance between the outer circumference of the pressure-retaining ring 24 on the bottom portion of the impeller 20 and the inner circumference of the bottom connection ring 23. In brief, it is the radial width (A) of the bottom portion of the impeller. If the space between the pressure relief holes B is divided by the radial width (A) of the bottom portion of the impeller, a ratio C is obtained.

$$\frac{B}{A} = C;\ B = A * C$$

In accordance with the test result, C values in the range of 0.32~0.67 are used by the preferred embodiments.

Based on the above equation, if the radial width (A) of the bottom portion of the impeller is set to be 10 mm and the space between the pressure relief holes (B) is set to be 3.5 mm. The resulting C value is 0.35. If the space between the pressure relief holes (B) is set to be 6.5 mm, the resulting C value is 0.65 which complies with the value in the optimal range of 0.32~0.67.

Figure 6:
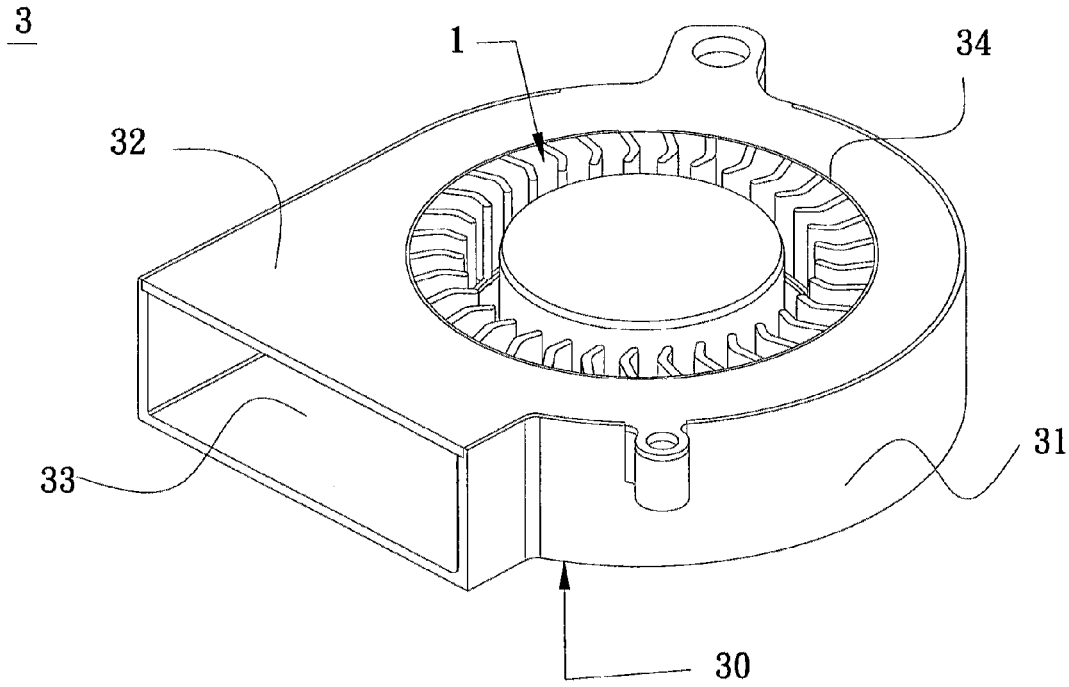
FIG. 6 is a three-dimensional external view showing the impeller of the preferred embodiment assembled in the housing in the present invention.

Please refer to FIG. 6, which is a three-dimensional external view showing the present invention assembled in a housing. The blower is a blower having air intake from a single direction. While the present invention is operating, the impeller structure 1 of the present invention is assembled in a housing 3 and the housing 3 is composed of a top cover 32 and a bottom casing 30, in which the housing 3 has an air outlet 33 at one end thereof, and an air inlet 34 is provided on an end face of the top cover 32 of the housing 3. The perimeter of the bottom casing 30 is encircled by a circular wall 32.

Figure 7:
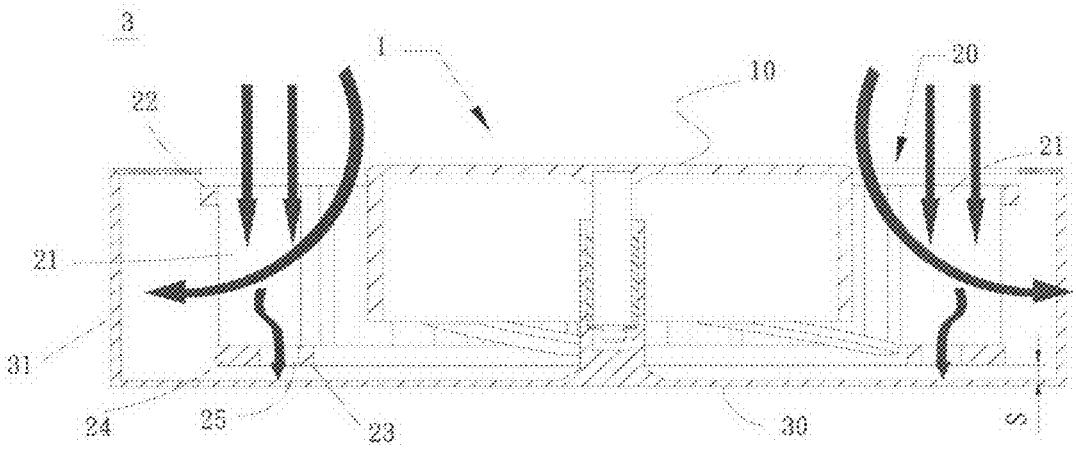
FIG. 7 is a cross-sectional view showing the operation of the impeller of the preferred embodiment assembled in the housing in the present invention.

Please refer to FIG. 6 and FIG. 7. FIG. 7 is a cross-sectional view showing the operation of the present invention assembled in the housing. While the impeller structure 1 is operating, an external current of air enters from the air inlet 34 of the top cover 32 of the housing 3 into the impeller 1 to form an axial flow. After being guided by the blades 21, the axial flow flows to the pressure-retaining ring on the bottom portion of the impeller 20. The pressure-retaining ring 24 can prevent air from promptly released from the bottom portion of the impeller 20, making that the pressure is reduced and the static pressure is lowered. The pressure relief holes 25 are provided between the pressure-retaining ring 24 and the bottom connection ring 23 so that air stored in the range within the pressure-retaining ring 24 and the blades 21 is released from the pressure relief holes 25. As there is a space provided between the bottom surface of the impeller 1 and the bottom casing 30 when the impeller 1 is assembled in the housing 3 and it is not tightly attached, the axial flow released from the pressure relief holes will generate a pressure exerted downwards on the inner bottom surface of the bottom casing 30, further driving the impeller 1 to speed up the rotation speed and increasing the air pressure and air volume of entire blower.

Moreover, there is also a current of axial flow entering from a region surrounded by the hub 10 and the end portion in the proximity of the blades 21. While the impeller 1 is rotating, a centrifugal force is generated. Due to the effect of the centrifugal force, the axial flow changes its flowing direction to further form a radial flow flowing toward the direction of the blades 21. The blades 21 are driven as a result of the rotation of the impeller 1 to blow the axial flow entering from the top end face of the blade and the radial flow subjected to the effect of the centrifugal force out of the impeller 1 such that the air flows to an accommodation space formed by a circular wall of the housing 3 and the impeller 1 and flows along the internal wall of the circular wall to be evacuated from the air outlet 33. Part of the axial flow is released by the pressure relief holes additionally disposed on the bottom portion. Therefore, the chance of collision generated between the axial flow and the radial flow in two directions is lessened, thereby smoothly releasing the radial flow by the blades and reducing the occurrence of turbulence generation.

Figure 8:
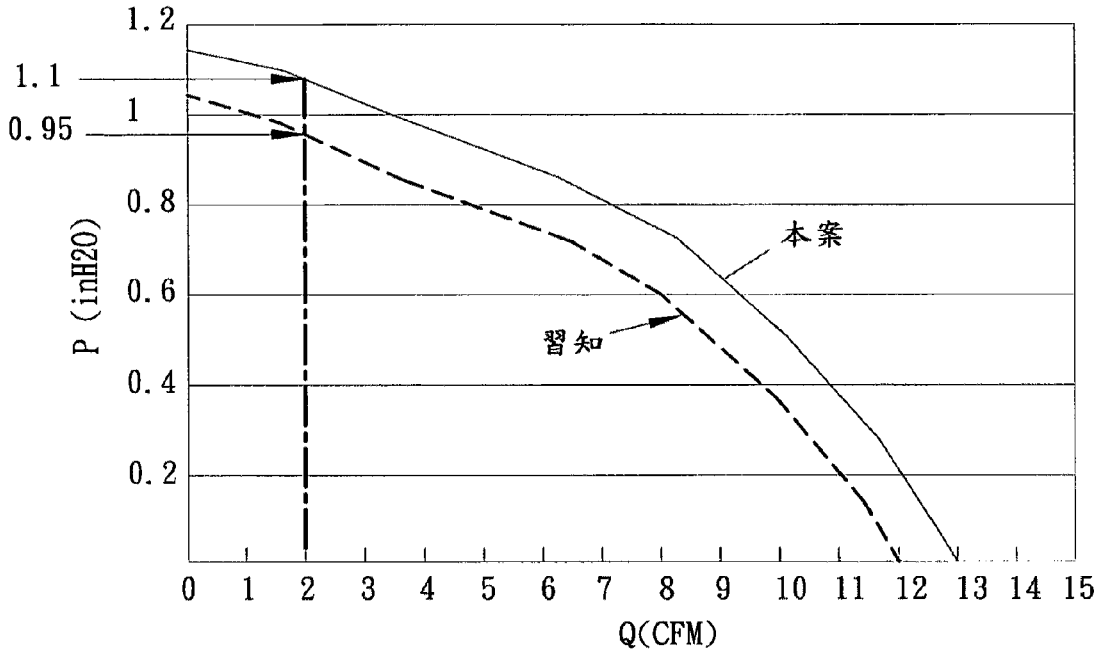
FIG. 8 is a P-Q curve diagram of the preferred embodiment of the present invention and the conventional skill.

Please refer to FIG. 8 which is a P-Q curve diagram for the present invention and the conventional impeller assembled in the housing. The Y coordinate represents value of static pressure and the X coordinate represents value of air volume, and the P-Q curve diagram is a data curve diagram when the ratio range of the pressure relief hole is 0.5.

As shown in FIG. 8, the dash line represents a curve measured when the conventional pressure-retaining ring is fully enclosed. For example, when the value of air volume Q is 2, the value of static pressure P is 0.95 approximately. However, the value of static pressure is 1.1 approximately when the value of air volume is the same. Despite the same air volume, the difference of the values of air pressure can be as high as 0.15 roughly. From the P-Q curve diagram after the mentioned measurements, air passing through the pressure relief holes by adding a pressure-retaining ring and pressure relief holes can certainly increase the overall air pressure and air volume of the blower. In contrast to the structure of conventional impeller structure of blower, the present invention can further enhance the working efficiency of the blower.

From the above-mentioned characteristics those features not only have a novelty among similar products and a progressiveness but also have an industry utility.

While the invention has been described in terms of what is presently considered to be the most practical and preferred embodiments, it is to be understood that the invention needs not be limited to the circular disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. An impeller structure of blower, comprising:

a hub having a spindle disposed centrally therein; and an impeller having a top connection ring, a bottom connection ring, a pressure-retaining ring, and a plurality of blades;

wherein a plurality of swirl-like ribs are extended from the periphery of the hub and connected with the bottom connection ring;

wherein the blades are vertically arranged around a periphery of the hub, an outer side edge on a top side of each of the blades is connected with the top connection ring, and an inner side of a bottom edge is connected with the bottom connection ring and an outer side thereof is connected with the pressure-retaining ring, and at least a pressure relief hole is provided on a space between the pressure-retaining ring and the bottom connection ring.

2. The impeller structure of blower as set forth in claim 1, wherein the pressure-retaining ring has a radial width extended inwards from a bottom edge of an outer side of the blades.

3. The impeller structure of blower as set forth in claim 1, wherein the pressure relief hole is constituted by a space formed among a bottom surface of each of two adjacent blades, the pressure-retaining ring and the bottom connection ring.

4. The impeller structure of blower as set forth in claim 1, wherein a width of the pressure relief hole is a multiple of 0.32~0.67 of a radial width of the impeller.

5. The impeller structure of blower as set forth in claim 1, wherein a bottom portion of the impeller is not fully enclosed by the pressure-retaining ring.

6. An impeller structure of blower, comprising:

a hub having a spindle disposed centrally therein; and an impeller having a top connection ring, a bottom connection ring, a pressure-retaining ring, and a plurality of blades;

wherein a width of the pressure-retaining ring is greater than a width of the top connection ring or the bottom connection ring;

wherein the blades are vertically arranged around a periphery of the hub, an outer side edge on a top side of each of the blades is connected with the top connection ring, and an inner side of a bottom edge is connected with the bottom connection ring and an outer side thereof is connected with the pressure-retaining ring, and at least a pressure relief hole is provided on a space between the pressure-retaining ring and the bottom connection ring.

7. The impeller structure of blower as set forth in claim 6, wherein the pressure-retaining ring has a radial width extended inwards from a bottom edge of an outer side of the blades.

8. The impeller structure of blower as set forth in claim 6, wherein the pressure relief hole is constituted by a space formed among a bottom surface of each of two adjacent blades, the pressure-retaining ring and the bottom connection ring.

9. The impeller structure of blower as set forth in claim 6, wherein a width of the pressure relief hole is a multiple of 0.32~0.67 of a radial width of the impeller.

10. The impeller structure of blower as set forth in claim 6, wherein a bottom portion of the impeller is not fully enclosed by the pressure-retaining ring.

* * * * *